US007807048B2

(12) United States Patent
Collette

(10) Patent No.: US 7,807,048 B2
(45) Date of Patent: Oct. 5, 2010

(54) THERMAL RECOVERY OF PETROLEUM CRUDE OIL FROM TAR SANDS AND OIL SHALE DEPOSITS

(76) Inventor: Jerry R. Collette, 1170 Lake Dr., Carrollton, OR (US) 44615

( * ) Notice: Subject to any disclaimer, the term of this patent is extended or adjusted under 35 U.S.C. 154(b) by 304 days.

(21) Appl. No.: 11/704,627

(22) Filed: Feb. 9, 2007

(65) Prior Publication Data

US 2007/0181465 A1 Aug. 9, 2007

Related U.S. Application Data

(60) Provisional application No. 60/771,447, filed on Feb. 9, 2006.

(51) Int. Cl.
*C10G 1/00* (2006.01)

(52) U.S. Cl. ..... 208/390; 198/657; 422/233; 208/400

(58) Field of Classification Search ..... 208/400, 208/390; 422/198, 233; 405/128.5, 128.55; 110/107, 347

See application file for complete search history.

(56) References Cited

U.S. PATENT DOCUMENTS 3,520,522 A * 7/1970 Schultz et al. ..... 165/104.18
4,279,722 A * 7/1981 Kirkbride ..... 204/157.15
4,373,453 A * 2/1983 Foresto ..... 110/216
4,622,210 A * 11/1986 Hirschberg et al. ..... 422/144
6,824,328 B1 * 11/2004 Vinegar et al. ..... 405/128.4
2003/0228196 A1 * 12/2003 Satchwell et al. ..... 405/128.5

* cited by examiner

*Primary Examiner*—Robert J Hill, Jr.
*Assistant Examiner*—Brian McCaig
(74) *Attorney, Agent, or Firm*—James Creighton Wray; Meera P. Narasimhan

(57) ABSTRACT

A tar sand volatilizer system thermally removes petroleum crude oil from tar sands or shale oil. A series of heated augers or thermal screws are used to elevate material temperature gradually using conductive heat transfer. The thermal screws blades and auger case receive a heated fluid. The screws are driven by variable speed drive systems. The unit is sized for any throughput rate desired. Hot clean material discharges into a rotary cooler and re-hydrator unit. The exhaust gases are pulled through a high temperature filter collector for particulate removal. The particulate free petroleum vapor laden hot gas exits the filter house into a multi stage condenser system with water chillers where the vapor temperature is gradually cooled. A microwave upgrader system processes crude oil using catalyst injected microwave technology to produce a diesel like fuel oil in a continuous process stream.

24 Claims, 11 Drawing Sheets

TAR SANDS & OIL SHALE VOLATILIZER SYSTEM

TAR SANDS & OIL SHALE
VOLATILIZER EMISSIONS SYSTEM

THERMAL RECOVERY OF PETROLEUM CRUDE OIL FROM TAR SANDS AND OIL SHALE DEPOSITS

This application claims the benefit of U.S. Provisional Application No. 60/771,447, filed Feb. 9, 2006, which is hereby incorporated by reference in its entirety.

TECHNICAL FIELD OF THE INVENTION

The present invention relates to the field of thermal recovery of petroleum crude oil from deposits of sand and shale.

BACKGROUND OF THE INVENTION

Processes are needed for the thermal recovery of petroleum crude oil from deposits of sand and shale that lie on or near the earth's surface in many parts of the world.

The true amount of reserves located throughout the world is not known. However, it is estimated that there are at least 30 billion barrels within tar sand and oil shale deposits in the United States alone. These reserves remain as yet un-tapped sources of valuable crude oil that does not require drilling and deep well recovery techniques. Petroleum laden sand and shale deposits are generally positioned on or near the surface of the ground and lay in horizontal layers or shelves that can be exposed, surface mined and processed with any number of available machines. Some deposits require that overburden be removed before mining, others have very little overburden. Some deposits also include levels or strata of green shale and white shale that lie between the petroleum layers. These layers must be mined and removed to access the tar sands and oil shale.

There are a number of different devices, systems and processes that have been developed over the years to process the tar sands and shale by mining the material and then extracting the crude oil or by in-situ extraction to strip and capture the petroleum crude. Some of these processes are operating today as commercially viable enterprises.

Systems that have been developed and used are hot water extraction, solvent extraction, gasification and condensation extraction. Variations on these techniques have been explored. In recent years however, new technologies have been created that permit the use of better, more efficient heating and handling techniques for the sand and shale along with liquid post recovery treatment systems that further process the extracted crude to enhance refining and remove certain undesirable constituents such as sulphur and nitrogen, therefore increasing the value of the preprocessed crude oil.

Needs exist for improved methods for the thermal recovery of petroleum crude oil from deposits of sand and shale.

SUMMARY OF THE INVENTION

The Tar Sand Volatilizer ("TSV") system of the present invention is a new and unique approach to dry thermal processing, thereby eliminating the need for water, steam, and solvent use for extraction. Processed material is deemed to be pure and safe for use in back fill and reclamation on site. The TSV system meets and exceeds all environmental requirements for air, water and soil, removing all possibility of contamination by leaching. By thermally removing all crude oil, the resulting sand is a pure and clean material. The pure and clean material may then be used for purposes that were not possible for residual material prior to thermal processing. The otherwise unusable residual material may then be used for the following purposes: agriculture, backfilling material, lake bed material, providing leveling and topping material for industrial development areas, commercial development areas and recreational development areas, and many other uses.

The present invention provides a thermal process that utilizes a series of graduated heated containers and heated augers or thermal screws to elevate material temperature in gradual stages using conductive heat transfer from hot surface contact. The thermal auger screw blades are hollow, as is the auger case or jacket, and these cavities receive a heated fluid from directly heated recycling shell and tube heat exchangers. The heated fluid is then pumped through the hollow jackets and auger blades. The heated medium can be different fluids, such as heat exchange oil, heat exchange chemical or liquid salt as well as superheated air and gas, depending upon the temperatures required in specific thermal screw contact heaters.

The screws preferably are driven by variable speed drive systems in order to vary the throughput speed and dwell time of the heated materials, which in turn controls their temperatures. Screw diameter and length also are specific to the requirements of throughput tonnage and temperature. The thermal screw heating system must be carefully sized in order to provide adequate square footage of conductive heat transfer surface area necessary to elevate material temperature to required levels for each temperature stage of the heating process. Turbulence plays an important role in the co-efficient of overall heat transfer and is accomplished by placing tines or blades on the trailing sides of flights of the thermal screw to lift and stir the material for complete surface contact of all particles.

The material is first mined using various mining techniques such as ripping, crushing, screening, milling, blasting, scraping, tunneling, boring, or pumping. Generally however, surface mining is accomplished using both track and rubber tired milling machines with rotary cutting heads that tear, shred and pick up the sized raw material which is generally crushed to approximately ¾" and minus. The crushed material (sand) is then fed by elevating conveyor into trucks that travel beside the moving machine. The trucks are loaded while moving, and therefore continuous mining is possible. Since tar sands tend to re-agglomerate rather quickly after stockpiling, it is best to mill only sufficient material to keep the process system fed at the hourly throughput rate. Pre mining and stockpiling of material for more than one day requires rehandling of agglomerated material, elevating costs. Material is trucked to surge piles near feed hoppers for weighing and metering into thermal process.

The TSV unit is sized for any throughput rate desired. However, a 60" diameter×36 foot long thermal screw size is the largest "transportable" fully assembled unit that is available. Smaller units in 24", 36" and 48" diameters are available in mobile and transportable configurations. Units larger than 60" diameter can be produced, however they must be field assembled and erected. One model of a TSV is designed to process 208 tons (416,000 lbs) per hour of 2% moisture content sand from an ambient temp of 60° F. to 950° F. maximum.

The thermal screws in the TSV system generally consist of four screws placed in series with each screw elevating the material temperature for a given stage. As an example, thermal screw #1 receives the 60° F. ambient temperature materials and boosts its temperature to approximately 250° F. at discharge. The first thermal screw also is responsible for removing all moisture from the material and moving the water vapor out of the system to a wet scrubber for disposal. The first thermal screw is heated by heat exchanger #1 which is directly fired with a natural gas, fuel oil, or propane burner to elevate temperature of the thermal fluid to approximately 700° F. as the heating medium. The heated thermal fluid is pumped and recycled at approximately 7.0 feet per second at approximately 250 to 400 gallons per minute volume through the hollow screw blades and through the hollow auger jacket.

Heat exchanger #1 utilizes a combustion system which is rated at 24.5 million BTUH input for an illustratively sized unit. Combustion system size will vary depending upon tonnage requirements. The low NOX, low CO combustion systems applied to the heat exchangers offer an exhaust gas flow at different volumes depending upon temperature of exhaust gases and firing rates. Heat exchanger #1 on an illustrative sized system produces an exhaust gas exit flow of approximately 10,485 ACFM at 650° F. This exit gas from each heat exchanger is called "low oxygen sweep gas" and is used to convectively assist the thermal elevation and evacuation of both moisture and volatilized petroleum gases from the heated thermal screws. The low oxygen content of the exhaust sweep gas also provides an inert gas or non-flammable, non-explosive environment and atmosphere for the volatilization process. The sweep gas carries the volatilized fumes or crude oil gases via insulated ducting to the particulate filter and on to the condenser systems.

Thermal screw #1 then discharges the material at approximately 250° F. directly into thermal screw #2 for further temperature elevation.

Thermal screw #2 , also using 700° F. thermal fluid, receives the material from thermal screw #1 at approximately 250° F. and devoid of any moisture. The material has given off its very light end constituents as a gas and will now be elevated from 250° F. to 450° F. The sweep gas temperature flow rate will increase to 12,392 ACFM at 850° F. The off gas vapor constituents will now be slightly heavier than thermal screw #1.

Thermal screw #3 uses 1,000° F. liquid salt as the heating medium and receives the material from thermal screw #2 at approximately 450° F. The material is elevated to approximately 650° F in thermal screw #3 with sweep gas temperature at approximately 14,294 ACFM @ 1,050° F. Off gas vapor constituents will be even heavier.

Thermal screw #4 uses 1,200° F. liquid salt as the heating medium and receives material from thermal screw #3 at approximately 650° F. The material is then elevated to 950° F. for final volatilization of remaining hydrocarbon. The sweep gas temperature in thermal screw #4 is approximately 16,187 ACFM @ 1,250° F. plus and carries the remaining gas to the condenser system. The material exits thermal screw #4 at approximately 950° F. and retains, if anything, a very slight amount of hard carbon or coke on some of the particle surfaces. This coke or heavy carbon residue does not leech or harm the environment.

The hot clean material at approximately 950° F. discharges into a rotary cooler and re-hydrator unit to be gradually cooled and moisturized. Cooling is accomplished by injecting clean cool material (sand) into the rotary vessel to mix and contact the hot material (sand) thereby quickly transferring heat via conduction to the colder particle. As the temperature is reduced below 250° F. via conductive cold sand mixing, water is injected for final cooling and re-hydration to approximately 5% to 8% moisture for dust free handling and stockpiling.

The exhaust or sweep gases from the four thermal screws are vacuumed via exhaust ducting with main exhaust fan at condenser exit thereby pulling gases through a particulate filter high temperature bag house (950° F. to 1,250° F.) collector for particulate removal. It is imperative that the exhaust gas from each thermal screw remain elevated above the volatilization threshold of the heaviest condensed vapor exiting each thermal screw, so as not to condense any vapors within the ducting or the interior of the particulate filter.

The particulate filter system, sized for an illustrative process unit, accepts a throughput of approximately 54,000 ACFM @ 950° F. to 1,200° F. The exhaust fan exerts a vacuum influence on the particulate filter designed to have a maximum pressure of 26.0" wc negative @ 250° F. rated. The particulate filter may use ceramic cloth bags, ceramic candle filters, or metallic filter material to withstand the continuous high temperature of 950° F. plus. The heated gases or petroleum vapors must move through the particulate filter without condensing any liquid on the filter material or on the inside of the bag house structure. The bag house is constructed of stainless steel 304, 309, 316 or any alloy material capable of accepting a minimum of 950° F. without structural or surface deformation or failure. The design of the bag house is modular, allowing for adequate expansion at each module joint. Pulse jet compressed air type filter cleaning systems are generally used however; reverse air, vibratory, pressure pulse, and atmospheric venting could also be utilized. Sonic horn systems could also be applied to enhance cleaning and may be used in conjunction with any of the above listed techniques.

As the particulate-free petroleum vapor laden hot gas exits the filter bag house, it is drawn by vacuum fan into the multi stage condenser systems with water chillers where the vapor temperature is gradually cooled, allowing the gas to condense and return to a liquid state. As the 950° F. gas is cooled, the first hydrocarbon phase is the heaviest API gravity, approximately 25 API. As the gases continue through the condenser cooling elements, the petroleum crude oil liquid becomes lighter, since volatilization levels decreases along with temperature. The combined petroleum crude exiting condensers at approximately 250° F. is drawn through exit manifolds with liquid pumps and either is forced into site storage tanks awaiting refinery collection, or is diverted through a shell and tube heat exchanger for temperature elevation of approximately 450° F. to 700° F. in preparation for final treatment in a microwave upgrader system.

The microwave upgrader system processes the 25 API gravity crude oil using catalyst injected micro wave technology to produce a diesel-like fuel oil in a continuous process stream, thereby upgrading the feed stock to a pre-refined state before marketing.

The microwave upgrader process must receive clean pre-processed crude devoid of sand and particulate matter in order to function. The microwave upgrader system also removes a significant portion of the sulphur and the nitrogen inherent in tar sands crude oil. It is this sulphur and nitrogen content that makes the tar sand deposits less desirable to refineries. Hydro cracking systems and sulphur removal systems are expensive to operate and maintain, elevating refining costs to process this type of crude.

A small stream of non-condensable gas or vapor may exit the condensers via a suction fan and is injected into a high temperature thermal oxidation unit (2,400° F.) having a 1.0 second dwell time in order to destroy any non-condensable vapors. That allows only pure hot air to exhaust to atmosphere. The superheated air exiting the thermal oxidizer is suitable for use in any type of energy recovery process such as waste heat boilers, heat exchangers, or pre-heat systems.

The TSV is a unique multi-stage system having multiple conductive heating thermal screws operating in parallel or in series at various temperature levels to vaporize crude oil to a gas vapor from its liquid state. As the sand or shale moves through the conductive and convective heating process, the light end crudes come off first at the lowest temperature, with the heaviest constituents leaving the liquid state to vapor phase in the final unit thereby stripping all available crude with the exception of a heavy solid carbon residue that remains on the sand but will not leech into water table when used as back fill. The rate of crude oil recovery from each ton of processed material is approximately 0.5049 barrels. Therefore, each device of an illustrative system is designed to have a through put process rate of 5,000 tons per 24 hour day.

This equates to an hourly through put rate of 208 tons per hour. At an hourly throughput rate of 208 tons the production rate of liquid pre-refined crude oil is 2,524 barrels per day per plant. Since the plant is designed as transportable, it is conceivable that multiple plants would be used to process several sites and could be located and moved convenient to excavation sites to minimize transportation costs. Plants may be completely self sufficient regarding electric power. Burner fuel may be used to generate electricity or the plants may use high line power sources with natural gas, propane, or fuel oil. Plants may be completely powered with diesel generator power as well.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
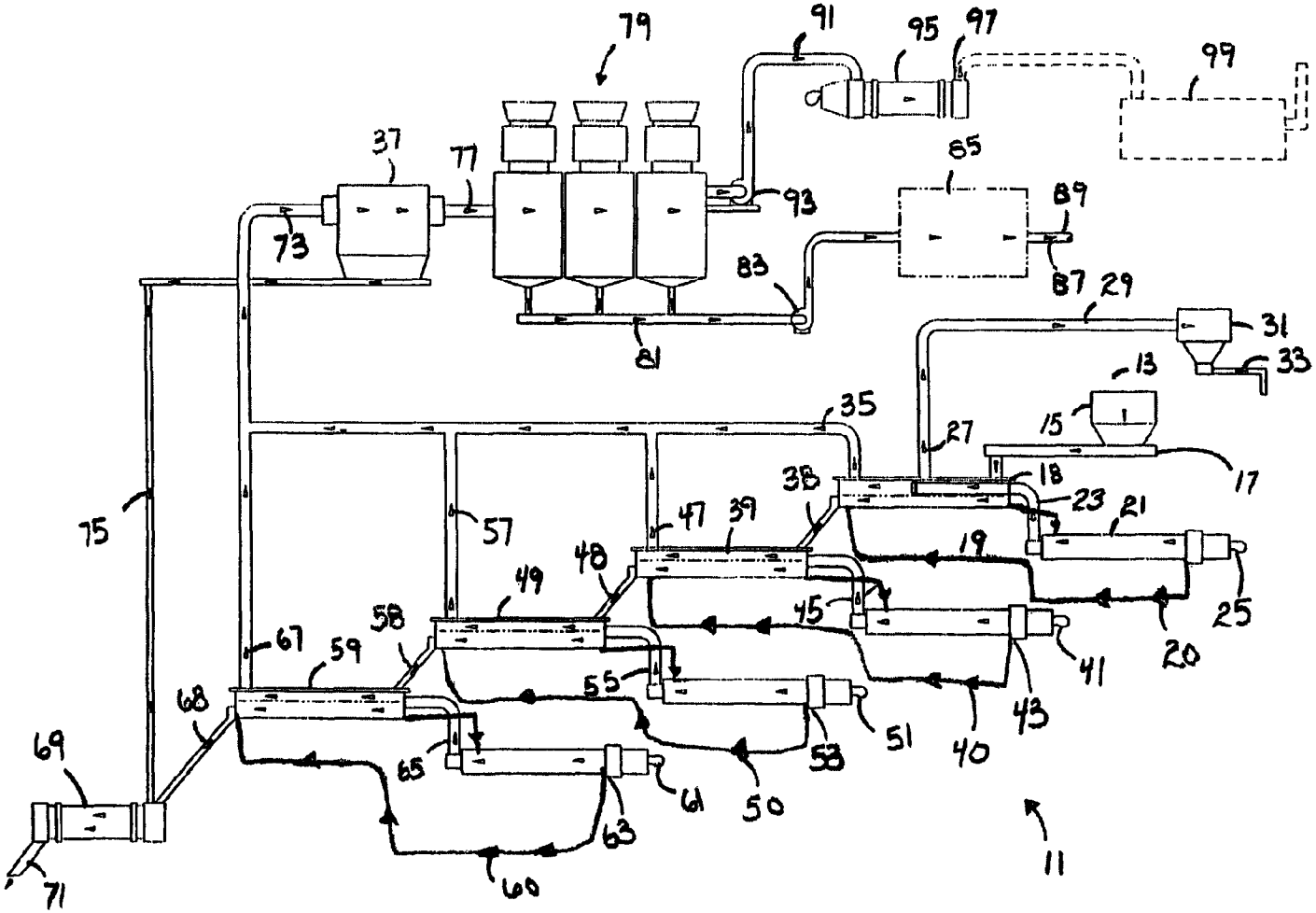
FIG. 1 is a schematic representation of the thermal recovery system.
Figure 2A:
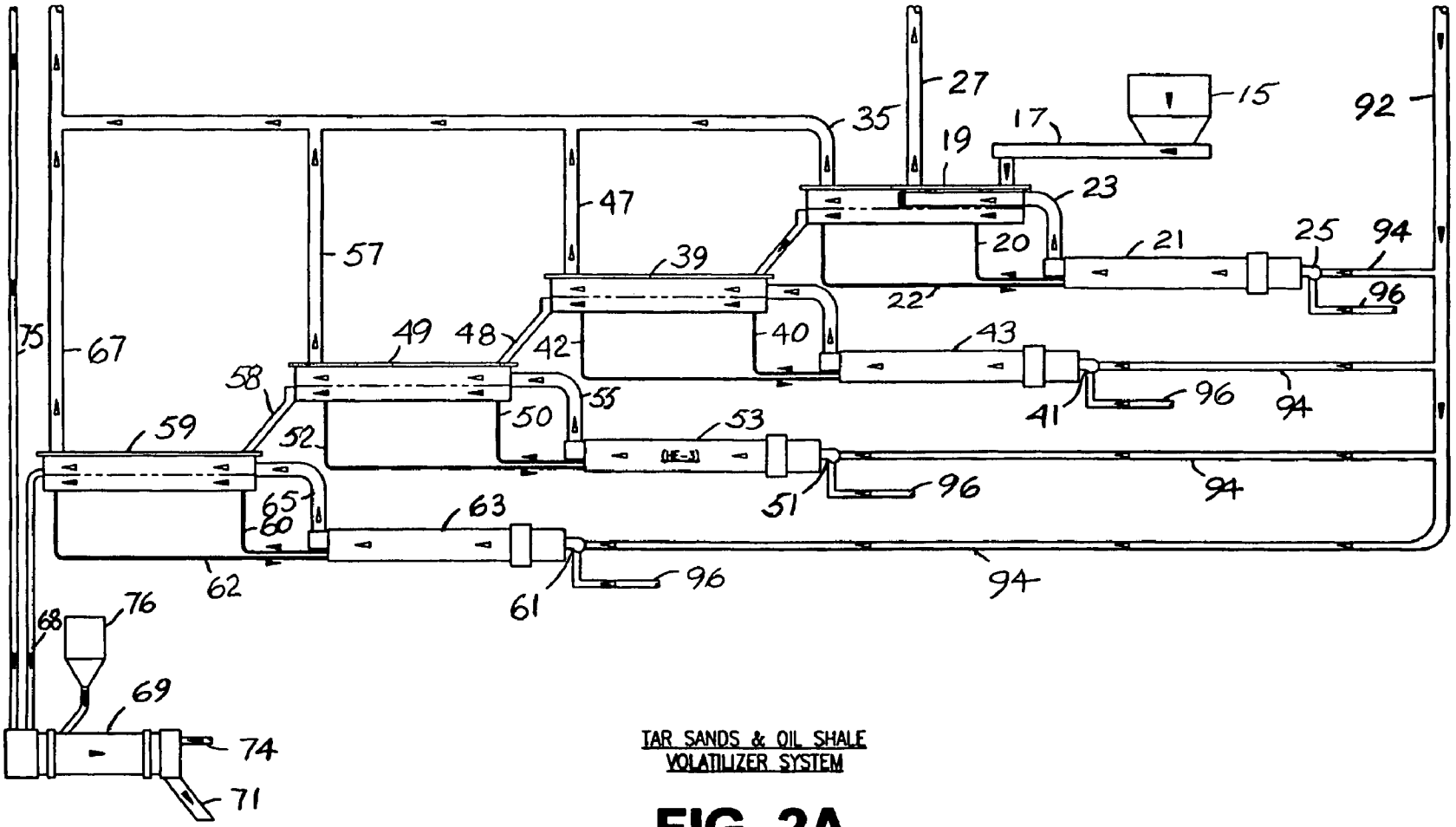
FIG. 2A is a schematic detail of the sand heating and treating section.
Figure 2B:
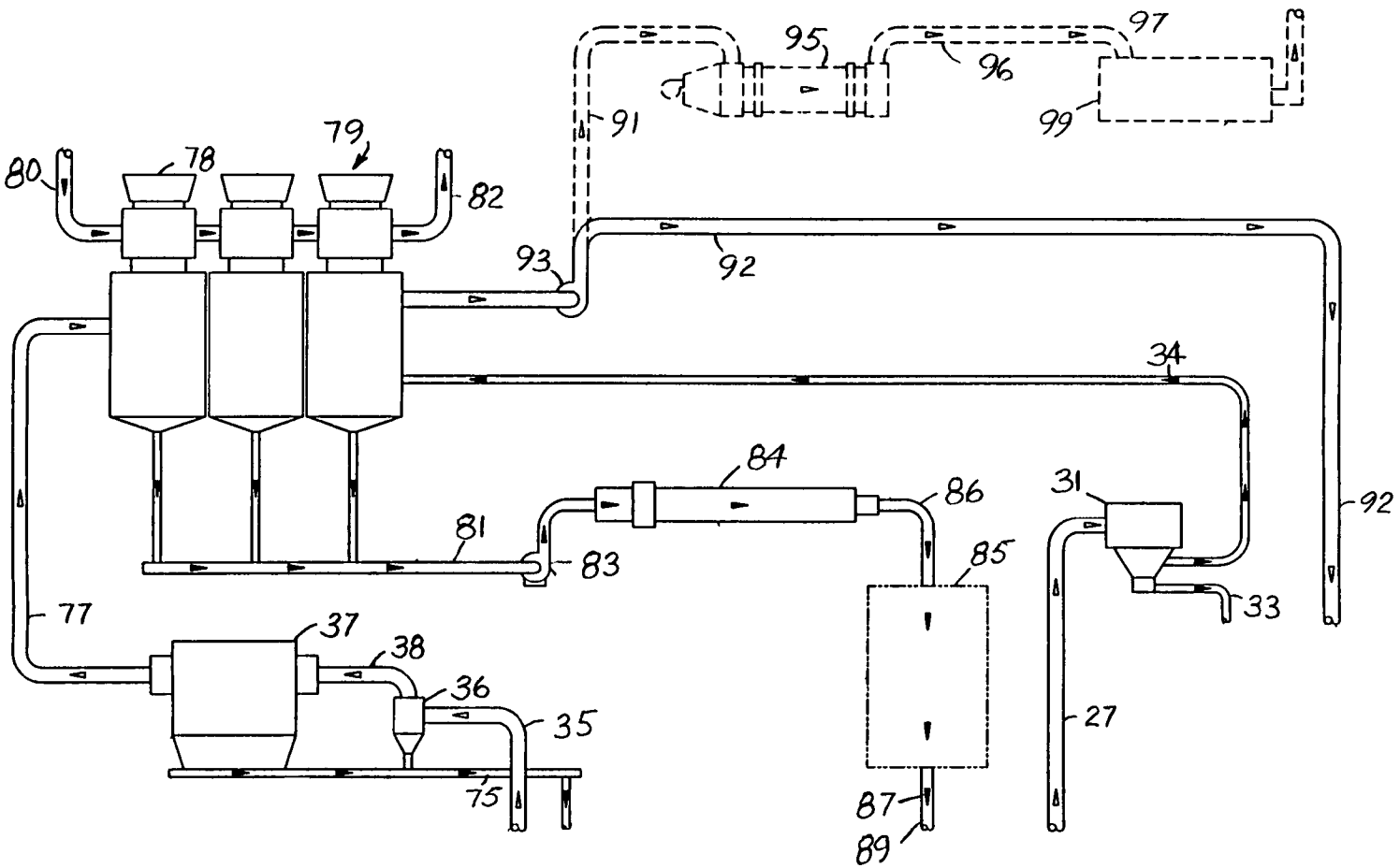
FIG. 2B is a schematic detail of the gas and vapor treatment and oil recovery section.

FIGS. 1 and 2A and 2B are schematic representations of the thermal recovery system 11. The thermal recovery system 11 shown in FIGS. 1 and 2A and 2B are examples of embodiments of the present invention. Other sizes and configurations are possible. In an illustrative example, approximately 208 tons of sand are processed per hour at approximately 5,000 tons/day. Tar sand input moisture content is approximately 2%. Sand inlet temperatures are approximately 60° F. and sand exit temperatures are approximately 950° F.

Raw oil-bearing sand 13 is dumped into a hopper 15. The raw sand 13 in hopper 15 is fed through a conveyor 17 at a predetermined flow rate. The raw sand 13 is conveyed into the first indirectly heated end 18 of a first auger conveyor 19. A first heat exchanger 21 with a first burner 25 heats a first heating fluid 20 to approximately 650° F. The first heat exchanger 21 also creates a first exhaust gas 23 at approximately 650° F., which is used as a sweep gas. The burner 25 may be any suitable type of burner, but is preferably a natural gas burner. The first exhaust sweep gas 23 flows into the first auger 19, and the first heating fluid 20 is pumped through the first hollow auger 19 and its associated hollow jacket in parallel or reverse flow. The first heating fluid 20 is recycled back for flow through the first heat exchanger 21. Water vapor 27 at approximately 250° F. is released from the raw sand as it moves through the first heated auger conveyor 13. The water vapor is captured from a central point on the heated jacket of the auger 19 and is sent 29 to a moisture vapor condenser 31, where the water vapor 27 leaves as liquid water 33, which may be used in the rotary sand cooler 69 to rehydrate the recovered sand.

Exhaust gas 35 from the first hollow auger heater 19, which contains light oil vapors and the first heater sweep gas exhaust 23, is captured and sent to cyclone separator 36 and/or a bag house 37. The exhaust gas 35 is at a temperature of approximately 550° F.

Sand 38 at approximately 250° F. exits the first hollow auger heater 19 and enters a second hollow auger heater 39. A second burner 41 on a second heat exchanger 43 heats a second heating fluid 40 to approximately 650° F. and exhaust gas 45 to approximately 850° F. The exhaust sweep gas 45 flows into the second hollow auger heater 39 and the second heating fluid 40 is pumped through the second hollow auger heater 39 and associated hollow jacket to indirectly heat the sand 38 to approximately 450° F. The second heating fluid 40 is cycled back through the second heat exchanger 43. Exhaust sweep gas 47 from the second heat exchanger 43 entrains the vapors within the second heated auger jacket and exits the second hollow auger heater 39 at approximately 750° F. and is mixed with the exhaust sweep gas and oil vapors 35 from the first auger 19 and sent to the cyclone 36 and/or bag house 37. The combined temperature of exhaust gases and oil vapors 35, 47 is approximately 650° F.

The sand 48 at approximately 450° F. exits the second hollow auger heater 39 and enters a third hollow auger heater 49. A third burner 51 on a third heat exchanger 53 heats a third heating fluid 50, in this case liquid salt, to approximately 1,150° F. and produces exhaust sweep gas 55 at approximately 850° F. The exhaust sweep gas 55 flows through the third hollow auger heater 49 and the third heating fluid 50 is pumped through the third hollow auger heater 49 and associated hollow jacket heater to heat the sand 48 to approximately 650° F. The third heating fluid is approximately 1,000° F. liquid salt 50, and is cycled in reverse flow back through the third heat exchanger 53. Exhaust sweep gas 55 from the third heat exchanger 53 entrains released oil vapors and exits 57 the third hollow auger heater 49 at approximately 950° F. and is mixed with the exhaust sweep gases and entrained oil vapors 35, 47 from the first auger 19 and second auger 39 and is sent to the cyclone 36 and/or bag house 37. The combined temperature of exhaust gases 35, 47, 57 is approximately 850° F.

The sand 58 at approximately 650° F exits the third hollow auger heater 49 and enters a fourth hollow auger heater 59. A fourth burner 61 on a fourth heat exchanger 63 heats a fourth heating fluid 60, liquid salt at approximately 1,200° F. and exhaust sweep gas 65 to approximately 1,250° F. The exhaust sweep gas 65 flows through the fourth hollow auger heater 59, and the fourth heating fluid 60 is pumped through the fourth hollow auger heater 59 and associated hollow jacket to heat the sand 58 to approximately 950° F. The fourth heating fluid 60 is cycled back through the fourth heat exchanger 63. Exhaust sweep gas 65 from the fourth heat exchanger 63 exits 67 with oil vapors from the fourth hollow auger heater 59 at approximately 1,150° F. and is mixed with the exhaust sweep gases 35, 47, 57 from the first hollow auger heater 19, second hollow auger heater 39 and third hollow auger heater 49 and all are sent to the cyclone 36 and/or bag house 37. The combined temperature of exhaust sweep gases and entrained oil vapors 35, 47, 57 and 67 is approximately 950° F.

The sand 68 at approximately 950° F. is fed into a rotary sand cooler 69. The sand 68 is cooled and then exits 71 the process as useable non-leaching byproduct materials. Dust 75 collected from the cyclone 36 and bag house 37 is also fed into the rotary sand cooler 69.

The combined exhaust sweep gases and oil vapors 73 are fed into the cyclone 36 and/or bag house 37 at approximately 950° F. The cyclone 36 and bag house 37 remove dust 75 from the exhaust sweep gas and oil vapors 73. The cleaned exhaust sweep gas and oil vapors 77 then pass through a cooling and condensing apparatus 79 with chillers 78. The cooling apparatus 79 has sequential cooler-condensers that condense crude oil 81 from the exhaust gas stream 77. The condensed crude oil 81 is passed through a booster pump 83 to elevate pressure and through an indirectly heated tube in tube heater 84 to increase its temperature.

If desired, the crude oil 81 is then passed through a microwave upgrader 85 to decrease the amount of nitrogen and sulphur in the crude 81. Processed crude 87 exits 89 the microwave upgrader 85. The microwave upgrader system 85 processes the crude oil 81 using catalyst and hydrogen injected microwave technology to produce a diesel like fuel oil 87 in a continuous process stream, thereby upgrading the feed stock to a pre-refined state before marketing.

The cooling and condensing apparatus 79 creates an exhaust gas stream 91 at approximately 180° F. The exhaust gas stream 91 passes through a suction fan 93 and into a tube 92 which feeds the combustible exhaust gas to heater burners 25, 41, 51, 61. Any part of the exhaust gas stream not used for the burners passes into oxidizer 95. Gas 97 exiting the oxidizer 95 may be passed through a waste heat recovery system 99 before exiting the system 11. The gas 97 exiting the oxidizer 95 is at approximately 1,250° F. to 1,400° F.

FIG. 1 shows the heating fluid moving through the heated augers in counterflow to sand movement.

FIG. 2A shows the heating fluid moving in parallel flow in the heated auger. Parallel flow is preferred.

Figure 3:
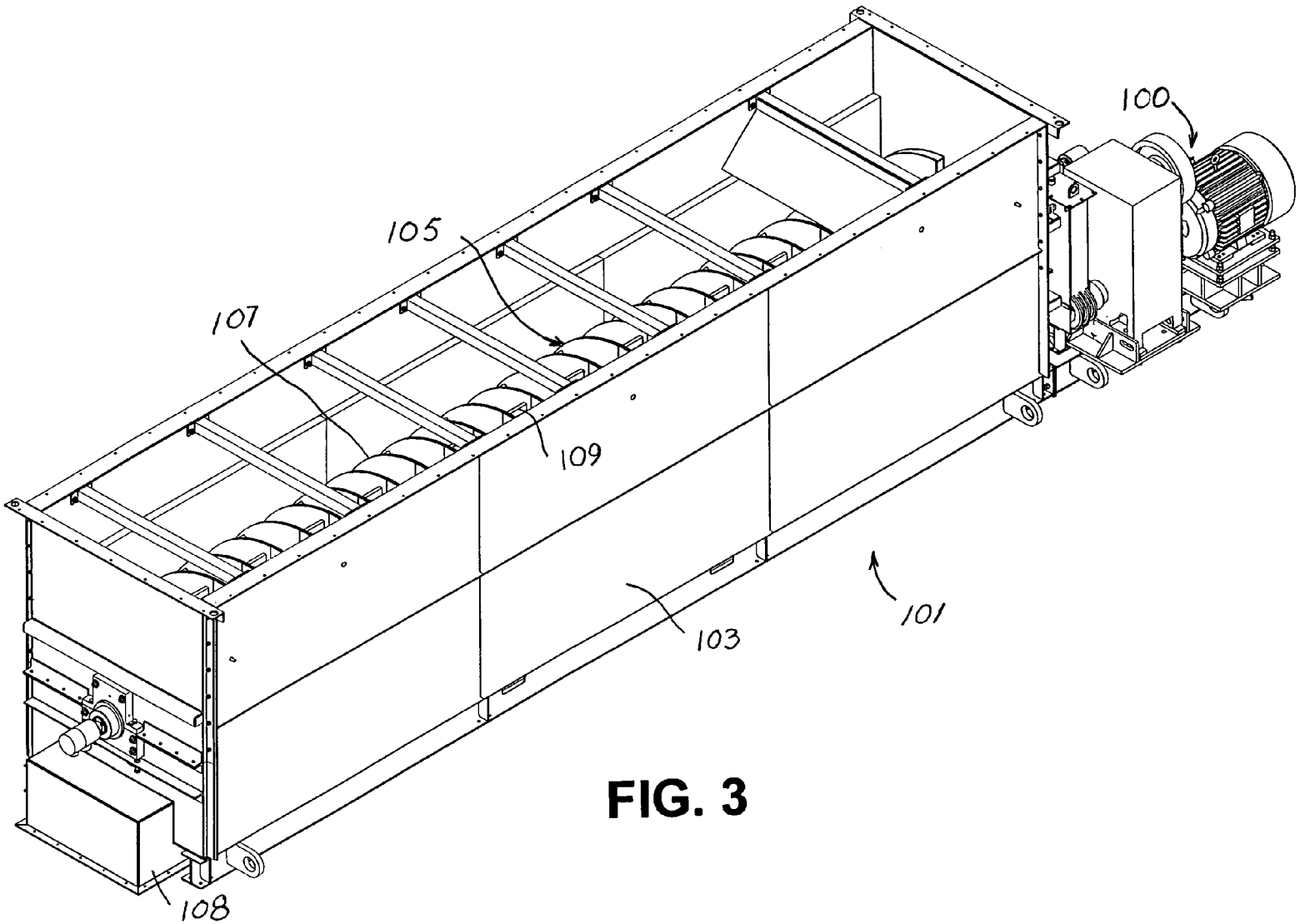
FIG. 3 is a view of an auger with a top removed.
Figure 4:
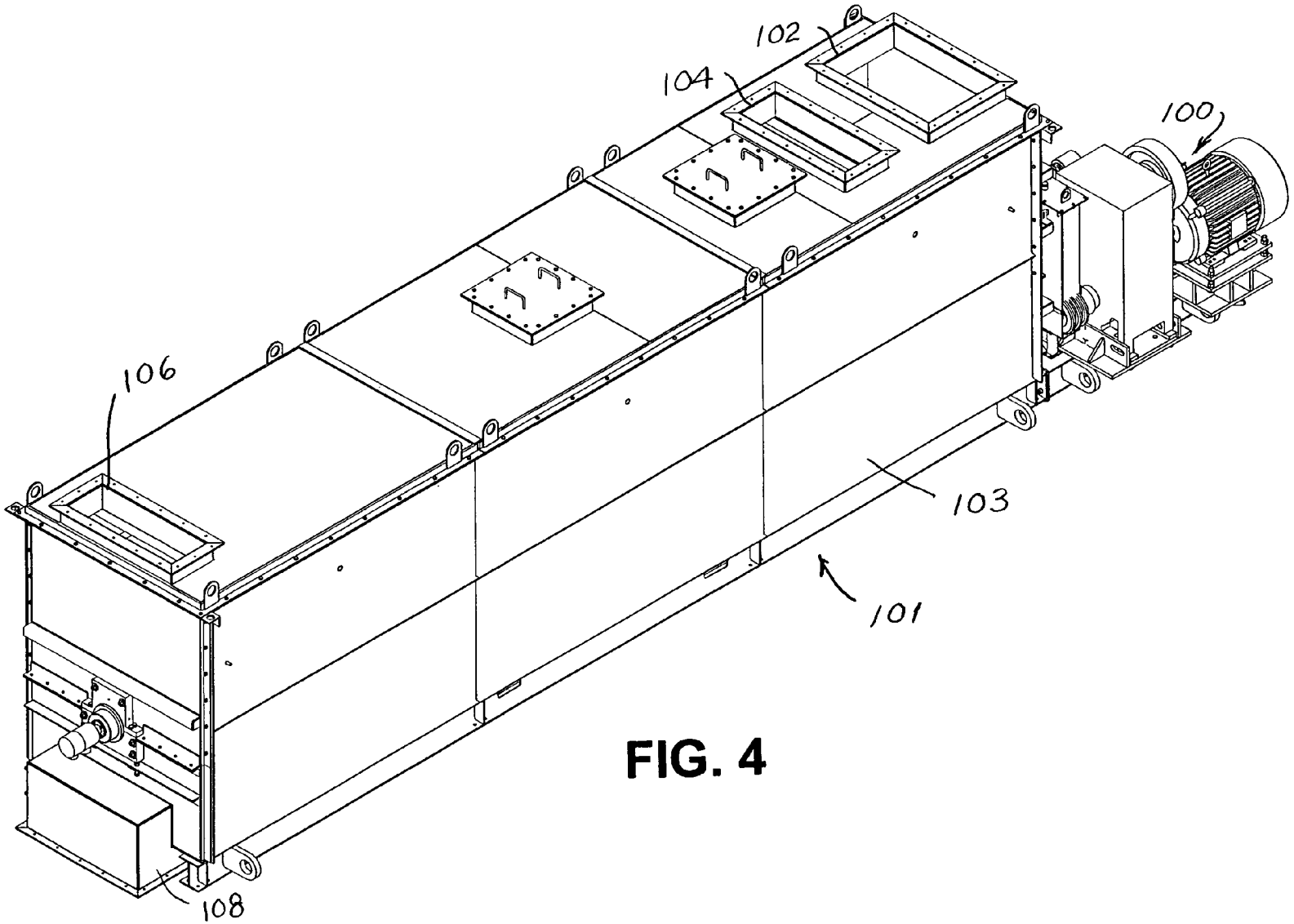
FIG. 4 is a perspective view of the auger.

FIG. 3 is a cutaway view of a hollow auger heater device 101. FIG. 4 is a perspective view of the hollow auger heater 101. A hollow jacket 103 surrounds the hollow auger 105. A series of the heated hollow auger or thermal screw heaters 101 elevates material temperature in gradual stages using conductive heat transfer from hot surface contact. The hollow auger or thermal screw blades or flights 107 are hollow, as is the auger case or jacket 103, and these hollow cavities receive a heated fluid from directly heated shell and tube exchangers. The heated fluid is then pumped into the hollow jackets and auger blades. The heated medium can be different fluids, such as heat exchange oil, heat exchange chemical or liquid salt as well as superheated air and gas, depending upon the temperature required in a specific thermal screw. The hollow blades 107 have rearward tines or plates 109 that continuously lift the oil-bearing sand particulates for mixing non-laminar flow. The tines 109 extend rearward and are spaced from the next rearward flights.

The hollow augers or screws 105 are generally driven by variable speed drive systems 100 in order to vary the throughput speed and dwell time of the product, which in turn controls temperature. Screw diameter and length also are specific to the requirements of throughput tonnage and temperature. The thermal screw heating system must be carefully sized in order to provide adequate square footage of conductive heat transfer surface area necessary to elevate material temperature to required levels for each temperature stage of the heating process. Turbulence plays an important role in the coefficient of overall heat transfer and is accomplished by placing tines or blades 109 on the trailing surface edge flights 107 of the thermal screw 105 to lift and stir the material for complete surface contact of all particles. The sand exhaust 108 is shown in FIGS. 3 and 4. The sand inlet 102, hot heater exhaust sweep gas inlet 104 and the sweep gas and vapor outlet 106 are shown in FIG. 4.

Figure 5:
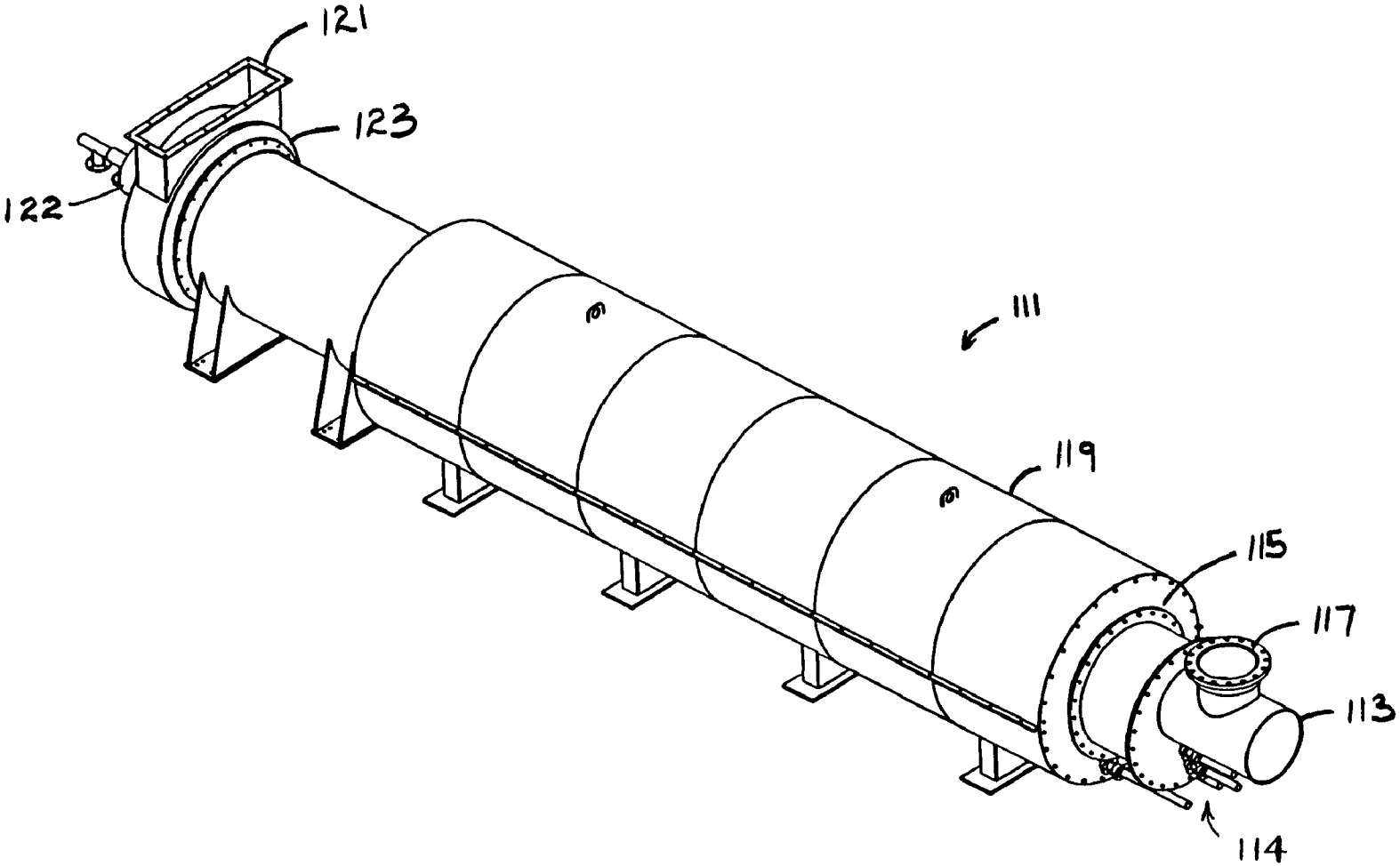
FIG. 5 is a perspective view of a four pass heat exchanger.

FIG. 5 is a perspective view of a four pass heat exchanger 111. A natural gas or similar type burner 122 of combustion chamber 123 is located at one end of the heat exchanger 111. An inlet 121 for oxygen-deficient air to reduce NOx formation brings the oxygen deficient air right down into the combustion zone. An insulated shell 119 surrounds the heat exchanger 111. Heated gas exits the heat exchanger 111 through an outlet 117 at an opposite end 113 from the burner of the heat exchanger. Connections 114 flow the heat exchange liquid into and out of the four pass heat exchanger.

Figure 6:
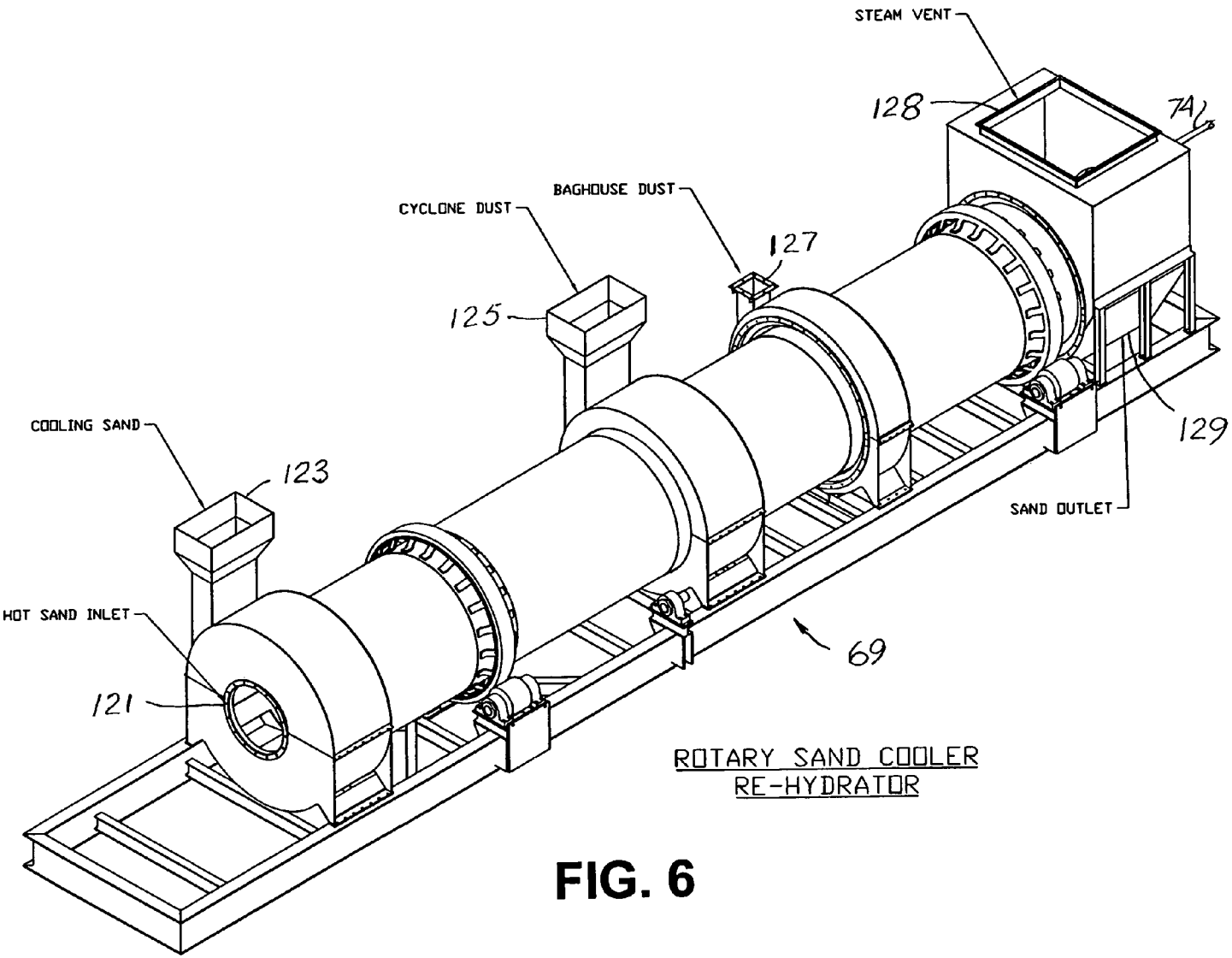
FIG. 6 is a perspective view of a sand cooler and rehydrator.

FIG. 6 is a perspective view of a sand cooler rehydrator 69. Hot clean material at approximately 950° F. discharges into the rotary cooler and rehydrator unit 69 to be gradually cooled and moisturized. Material enters the sand cooler rehydrator 69 via an inlet 121. Cooling is accomplished by injecting clean cool material (sand) into the rotary vessel at inlet 123 to mix and contact the hot material (sand) thereby quickly transferring heat via conduction to the colder particle. Cyclone dust enters at inlet 125 and bag house dust enters at inlet 127. As the temperature is reduced below 250° F. via conductive cold sand mixing, water is injected 74 for final cooling and re-hydration to approximately 5% to 8% moisture for dust free handling and stockpiling. Additional inlets allow for addition of cold sand at various points along chamber of cooler rehydrator 69. Steam exits from steam vent 128 for collection particle separation, condensation and reuse, such as at water inlet 72. Cooled rehydrated sand exits at sand outlet 129.

Figure 7:
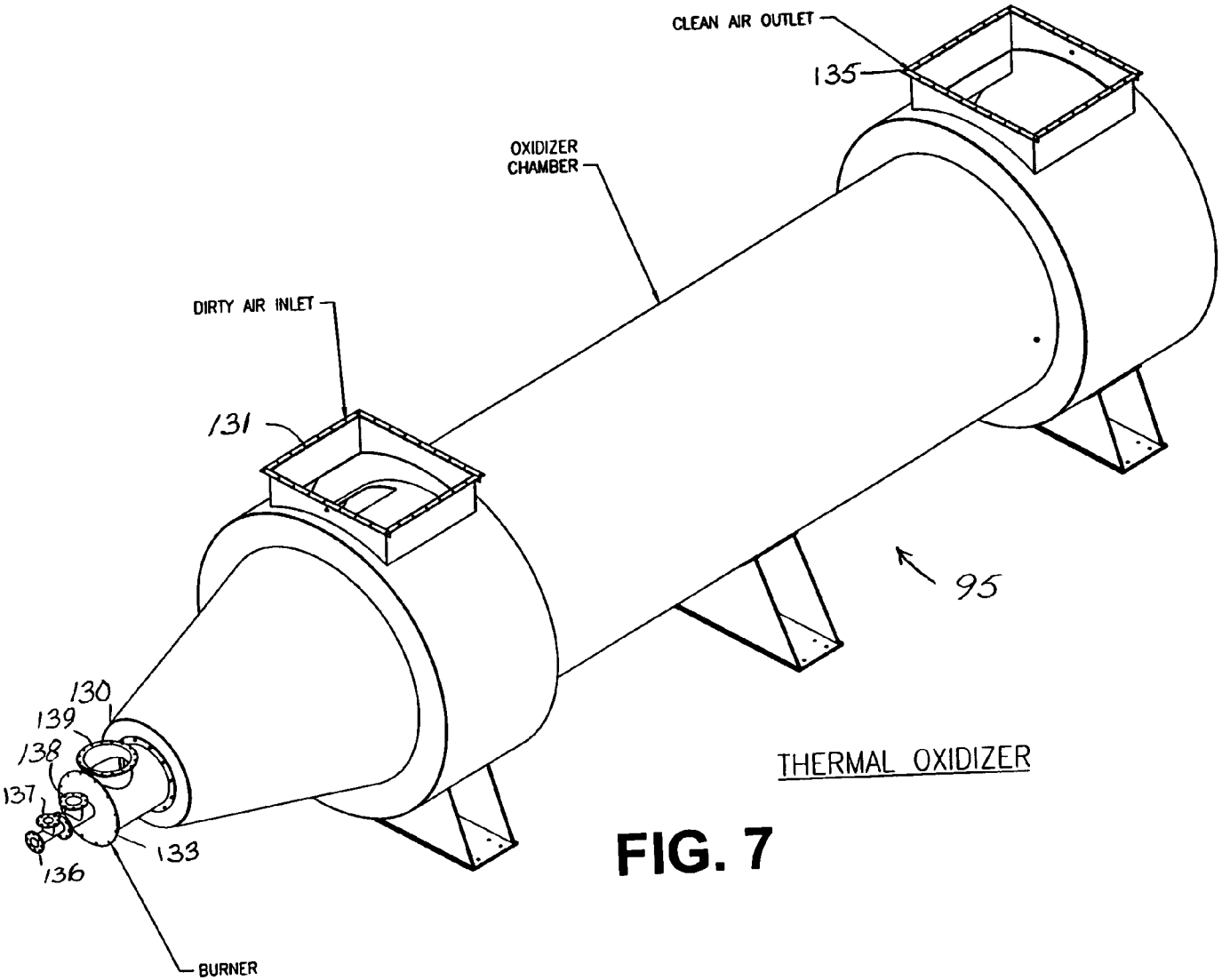
FIG. 7 is a perspective view of an exhaust gas oxidizer.

FIG. 7 is a perspective view of thermal oxidizer 95. System exhaust gas 91 enters the oxidizer through an inlet 131. A burner 133 at the entrance end 130 of the oxidizer 95 raises the temperature of the system exhaust gas before exiting the thermal oxidizer 95 through a clean air outlet 135. A high temperature thermal oxidation unit (approximately 2,400° F.) has an approximately 1.0 second dwell time in order to assure destruction of any non-condensable vapors. That allows only pure hot air to exhaust to atmosphere. The super heated air exiting the thermal oxidizer is suitable for use in any type of energy recovery process such as waste heat boilers 95 (FIG. 1), heat exchangers, or pre-heat systems. The burner 133 has alternative inlets 136, 137 and 138 for oil, gas or system exhaust fuels and a combustion air inlet 139.

Figure 8:
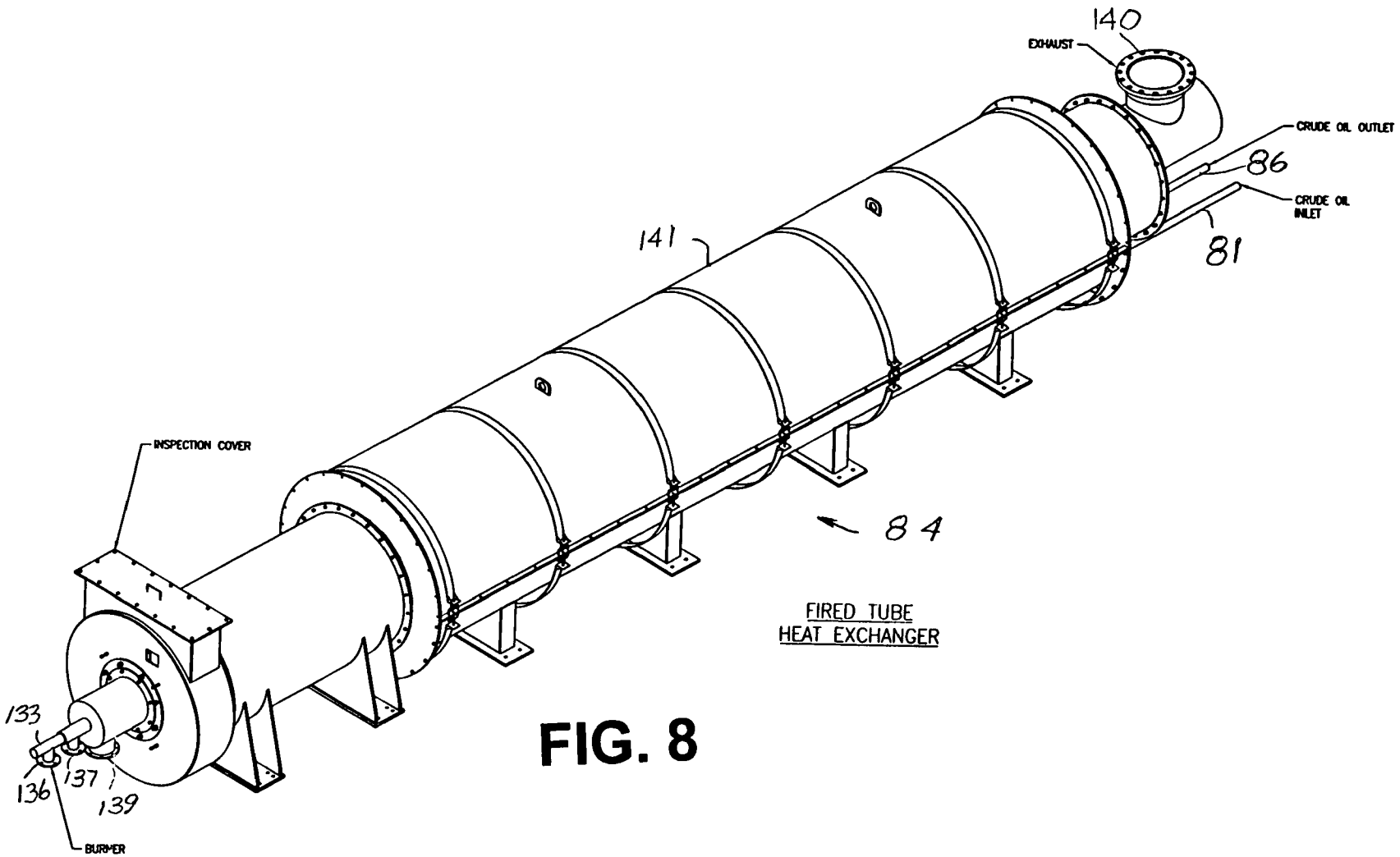
FIG. 8 is a perspective view of a heat exchanger for preheating product oil before upgrading.

FIG. 8 shows a fired tube heat exchanger 84 for reheating the crude oil from inlet 81 before it exits 86 to the microwave upgrader 85. A burner 133 has alternate inlets 136, 137 for oil or natural gas fuel and an air inlet 139. Exhaust exits at exhaust port 140. Crude oil within chamber 141 is confined in a continuous tube.

Figure 9:
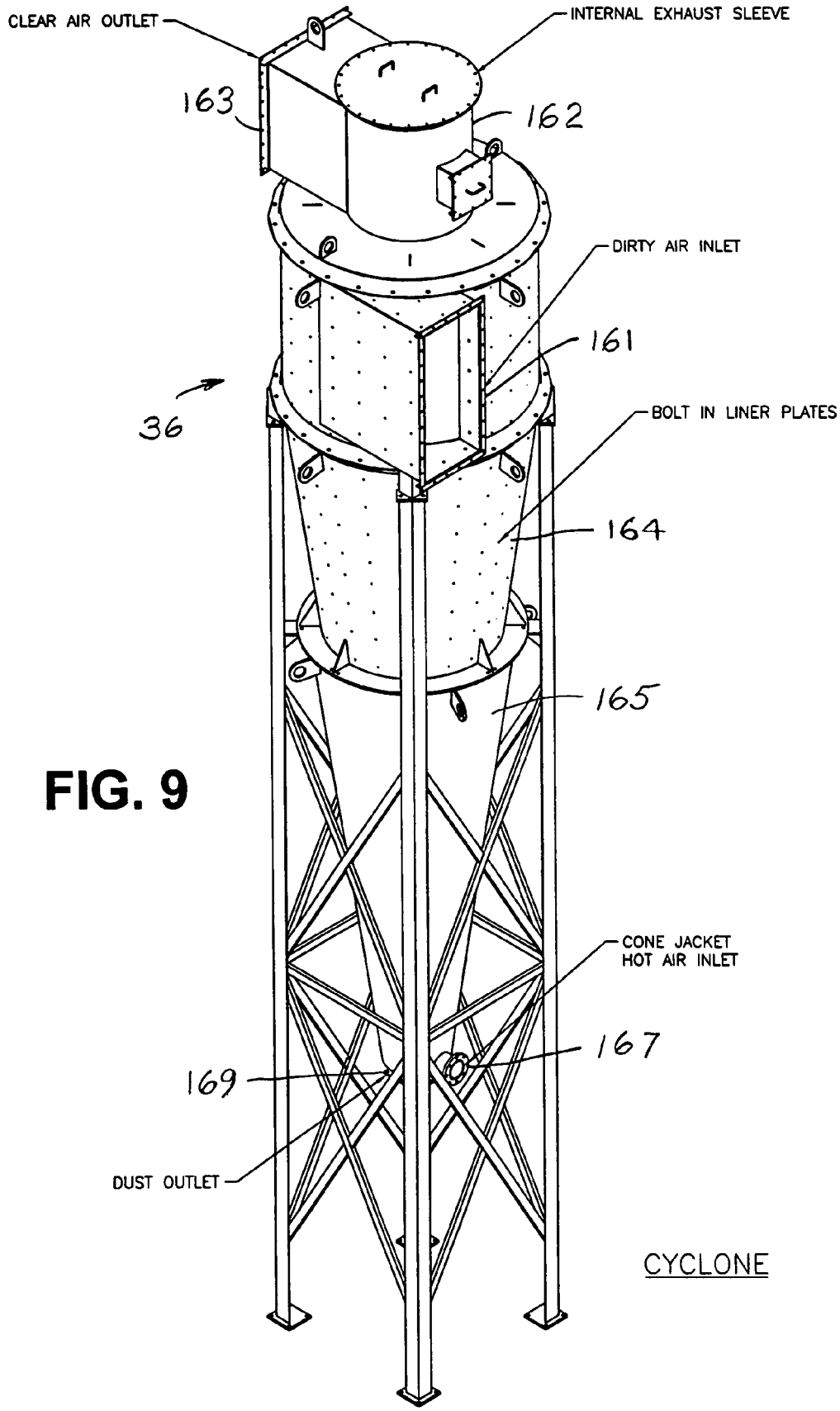
FIG. 9 is a perspective view of a cyclone separator.

FIG. 9 is a view of the cyclone 36b in FIGS. 1A-1C. Dust and oil vapor laden sweep gas enters through inlet 161, swirls through the enclosure and exits through internal exhaust sleeve 162 and outlet 163. Bolted-on liner plates 164 surround the air chamber. Cone jacket 165 has a hot air inlet 167 to prevent condensation of hot light vapors which exit with the sweep gas through the exhaust sleeve and outlet 163. Particles and dust drop through dust outlet 169.

Figure 10:
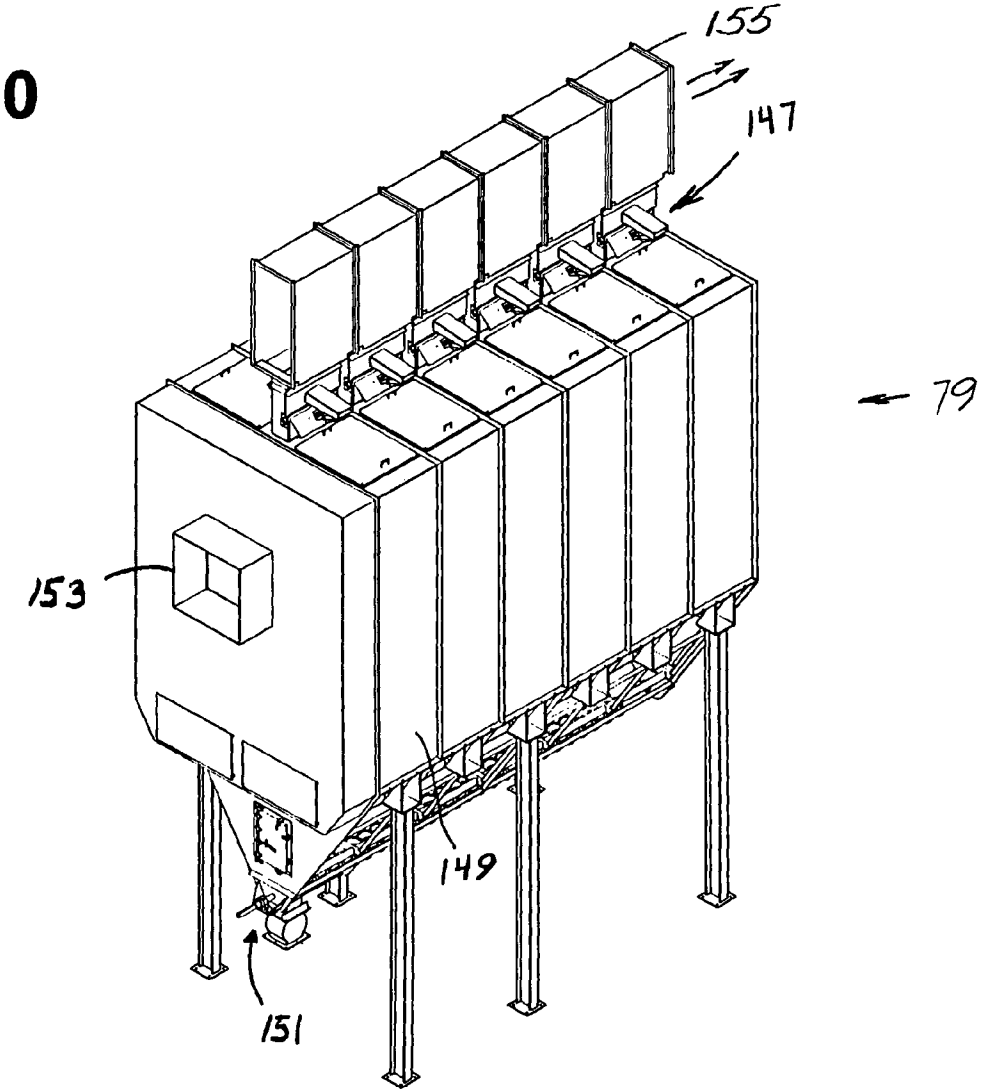
FIG. 10 is a perspective view of a bag house.

FIG. 10 is a perspective view of a bag house 79 which may be used as the bag house 37 in FIGS. 1A-1C. The exhaust or sweep gases from the four thermal screws or from cyclone 36 are vacuumed via exhaust ducting with main exhaust fan at condenser exit thereby pulling gases through a filter high temperature bag house (approximately 950° F. to 1,250° F.)

collector 79 for particulate removal. It is imperative that the exhaust gas from each thermal screw remain elevated above the volatilization threshold of the heaviest vapor exiting each thermal screw so as not to condense any vapors within the ducting or the particulate filter.

The particulate filter system sized for an illustrative process unit accepts a throughput of approximately 54,000 ACFM @ 950° F. to 1,200° F. The exhaust fan exerts a vacuum influence on the particulate filter designed to have a maximum pressure of 26.0" wc negative @ 250° F. rated. The particulate filter may use ceramic cloth bags, ceramic candle filters, or metallic filter material to withstand the continuous high temperature of 950° F. plus. The heated gases or petroleum vapors must move through the particulate filter without condensing any liquid on the filter material or on the inside of the bag house structure. The bag house 145 is constructed of stainless steel 304, 309, 316 or any alloy material capable of accepting a minimum of 950° F. without structural or surface deformation or failure. The design of the bag house 145 is modular, allowing for adequate expansion at each module joint. Pulse jet compressed air type filter cleaning systems 147 are generally used however; reverse air, vibratory, pressure pulse, and atmospheric venting could also be utilized. Sonic horn systems could also be applied to enhance cleaning and may be used in conjunction with any of the above listed techniques. Each modular unit 149 is connected in series with a dust screw conveyor 151 at the base. An air inlet is connected 153 at the first modular unit 149. Cleaned hot sweep gas and oil vapors leave the bag house 145 at exhaust 155.

The invention is described with reference to oil recovery from oil sands. The invention is useful in recovering oil from tar ponds and lakes and from oil shales. For the latter, a crusher is employed before the hoppers 13 in FIGS. 1 and 2A.

In a preferred embodiment, steam vented from the sand cooler and rehydrator is collected, condensed and reused as water for introducing into the rehydrator. Dust may be separated from the steam by a cyclone separator or the condensate may be cleaned in a centrifuge before using the water.

The numbers of fluid heaters and indirectly heating augers and chambers may be varied from one to any number which is represented by n or nth. A sequence of our fluid heaters and heated augers and jackets is preferred to sequentially bring the material described in the example, the tar sands, to temperatures in which the oil contained in the sands is vaporized for recovery. The vapors and sweep gas may be individually or collectively cleaned and condensed, as shown in the example.

While the invention has been described with reference to specific embodiments, modifications and variations of the invention may be constructed without departing from the scope of the invention, which is defined in the following claims.

I claim:

1. Oil recovery apparatus, comprising:

conveyors for conveying oil bearing materials;

heaters which are fired with a gas or liquid fuel burner for heating the conveyors and indirectly heating the materials and volatizing oil vapors from the materials;

heater exhaust gas conduits from the said heaters for sweeping the volatized vapors;

cleaners for removing particles from the swept volatized vapors; and condensers for condensing the volatized vapors into a product stream.

2. The apparatus of claim 1, wherein the conveyors comprise sequential conveyors and the heaters comprise sequential heaters for sequentially increasing temperature of the oil bearing materials by transferring the materials to subsequent conveyors and by indirectly heating the materials to increasingly higher temperatures in the subsequent conveyors.

3. The apparatus of claim 2, wherein the heaters comprise first, second and nth fluid heaters and the first, second and nth heated conveyors and conveyor jackets respectively connected by fluid lines and heater exhaust gas conduits to the respective fluid heaters, wherein the heated fluid transfers heat from the heaters to the respective heated conveyors and jackets, wherein the jackets have plenums above the conveyors into which oil vapors from the heated materials flow and through which heated exhaust gas from the respective heaters flow for entraining the oil vapors and sweeping the vapors into vapor conduits, and wherein the materials move between subsequent heated conveyors and conveyor jackets for increased heating in the first to nth conveyors.

4. The apparatus of claim 3, further comprising a rotary materials cooler and rehydrator connected to a hot materials outlet of the nth heated conveyor, a clean cool sand input connected to the rotary cooler and rehydrator for mixing with hot materials and cooling the hot materials, a cleaner dust input connected to the rotary cooler and rehydrator, and a water inlet connected to the rotary cooler and rehydrator for rehydrating the materials.

5. The apparatus of claim 3, further comprising a thermal oxidizer, and wherein the exhaust sweep gases and uncondensed vapors from the condenser flow into a thermal oxidizer for oxidizing the uncondensed vapors.

6. The apparatus of claim 5, further comprising conduits conducting exhaust gases and uncondensed vapors to burners on the heaters.

7. The apparatus of claim 1, wherein the conveyors comprise augers rotating in enclosures, and further comprising tubes in the heaters and fluid lines connecting the tubes in the heaters to the augers and enclosures, heating fluid disposed in the tubes, fluid lines, augers and enclosures, and wherein the fluid lines are connected for flow of the heating fluid in the augers and enclosures.

8. The apparatus of claim 7, wherein the augers comprise helical blades having rearward surfaces, and further comprise tangs extending rearward from the rearward surfaces of the blades for agitating the materials.

9. The apparatus of claim 1, wherein the cleaners are selected from the group comprising cyclones and bag houses.

10. The apparatus of claim 1, wherein the cleaner is a bag house.

11. The apparatus of claim 10, wherein the cleaners further comprise a cyclone particle separator preceding the bag house.

12. The apparatus of claim 1, further comprising a booster pump and a microwave upgrader connected to the product stream for producing a processed crude output.

13. The apparatus of claim 12, further comprising a fire tube product heater between the pump and the microwave upgrader for heating the product before flowing the product into the microwave heater.

14. The apparatus of claim 1, further comprising a rotary material cooler and rehydrator connected to the conveyors for cooling and rehydrating the materials.

15. The method of recovering oil from oil bearing materials, comprising:

providing fuel to an indirect heater which is directly fired with a burner;

providing oil bearing materials to an indirect heater;

indirectly heating the oil bearing materials creating first water vapors and then oil vapors from the oil bearing materials;

sweeping the water vapors away;

sweeping the oil vapors into a conduit with exhaust gases from the burner;

cleaning the swept vapors;

condensing the vapors; and producing oil.

16. The method of claim 15, further comprising elevating pressure of the produced oil and upgrading the produced oil to a processed oil.

17. The method of claim 16, further comprising heating the produced oil before the upgrading.

18. The method of claim 15, further comprising conducting uncondensed vapors from the condensing to heaters for fueling the heaters for the indirect heating of the materials.

19. The method of claim 15, further comprising drawing the swept vapors through the condenser to a thermal oxidizer, oxidizing to a thermal oxidizer, oxidizing uncondensed vapors in the thermal oxidizer, and exhausting gas cleaned of uncondensed vapors.

20. The method of claim 15, wherein the indirectly heating further comprises heating first, second and nth fluids in first, second and nth heaters, circulating the fluids respectively through the first, second and nth conveyors and jackets, and successively transferring materials having increased heat from the first to the nth conveyors.

21. The method of claim 20, further comprising releasing hot exhaust gas from the respective heaters, and sweeping oil vapors from the respective conveyors and jackets into first, second and nth vapor conduits before the cleaning and condensing of the swept vapors.

22. The method of claim 21, wherein the cleaning comprises removing entrained dust from the swept vapors in a cyclone and a bag house.

23. The method of claim 22, further comprising flowing the heated materials from the nth conveyor and jacket and dust from the cyclone and bag house to rotary materials, cooling a rehydrating, adding cool particles to the heated cool particles with the heated materials and dust, introducing water to the mixed materials particles and dust, and releasing cooled and rehydrated materials.

24. The method of claim 15, wherein the oil bearing materials are selected from oil sands, oil shale and tar deposits.

* * * * *